United States Patent [19]

Kindylides

[11] Patent Number: 4,633,630

[45] Date of Patent: Jan. 6, 1987

[54] STRUCTURAL BLOCKS AND STRUCTURAL SYSTEM UTILIZING SAME

[75] Inventor: Stavros Kindylides, Victoria, Canada

[73] Assignee: G. R. Block Research and Development Corporation, Victoria, Canada

[21] Appl. No.: 833,094

[22] Filed: Feb. 25, 1986

[51] Int. Cl.[4] ..... E06B 1/00; E04B 1/04; E04C 1/10

[52] U.S. Cl. ..... 52/204; 52/284; 52/286; 52/570; 52/594

[58] Field of Search ..... 52/204, 284, 286, 429, 52/430, 570, 571, 572, 574, 591, 594

[56] References Cited

U.S. PATENT DOCUMENTS

| | | | |
|---|---|---|---|
| 932,157 | 8/1909 | Matthews | 52/571 |
| 1,356,590 | 10/1920 | Baumann | 52/574 |
| 1,493,811 | 5/1924 | Frewen | 52/570 X |
| 2,610,503 | 9/1952 | Hall | 52/284 X |
| 3,247,633 | 4/1966 | Schultz et al. | 52/204 |
| 3,305,982 | 2/1967 | Steele | 52/286 X |
| 3,557,505 | 1/1971 | Kaul | 52/570 X |
| 3,618,279 | 11/1971 | Sease | 52/227 |
| 3,888,060 | 6/1975 | Haener | 52/284 |

FOREIGN PATENT DOCUMENTS

| | | | |
|---|---|---|---|
| 182218 | 6/1955 | Austria | 52/570 |
| 537950 | 5/1955 | Belgium | 52/591 |
| 815245 | 10/1951 | Fed. Rep. of Germany | 52/284 |
| 766682 | 4/1934 | France | 52/430 |
| 1028668 | 2/1953 | France | 52/284 |
| 1056459 | 10/1953 | France | 52/571 |
| 65005 | 9/1955 | France | 52/574 |
| 1272952 | 8/1961 | France | 52/429 |
| 1526030 | 4/1968 | France | 52/574 |
| 517747 | 3/1955 | Italy | 52/570 |
| 44088 | 5/1918 | Sweden | 52/570 |
| 192345 | 2/1923 | United Kingdom | 52/570 |

*Primary Examiner*—Alfred C. Perham

*Attorney, Agent, or Firm*—Chernoff, Vilhauer, McClung & Stenzel

[57] ABSTRACT

A system of structural blocks comprised of longitudinally extending members having vertical inner and outer faces. The basic structural blocks have webs centered on and projecting away from the inner faces of the blocks and extending from top to bottom of the blocks along one-half their longitudinal extent. Tongue and groove projections and recesses on the inner faces and on the webs mate with corresponding projections and recesses on identical blocks, whereby a plurality of such blocks may be longitudinally, transversely and vertically interlocked together. Corner, jamb, pilaster, beam, junction and web blocks are provided, together with a corresponding series of half height blocks, to interlock with the basic blocks and with each other so as to enable construction of a wide variety of buildings or structures.

26 Claims, 30 Drawing Figures

STRUCTURAL BLOCKS AND STRUCTURAL SYSTEM UTILIZING SAME

FIELD OF THE INVENTION

This application pertains to a structural block and a structural system utilizing same. More particularly, the application pertains to a system of structural blocks which may be longitudinally, transversely and vertically interlocked together, without the use of bonding agents, and by unskilled or semi-skilled labourers, to construct a wide variety of buildings having improved longevity, fire safety, acoustical isolation and thermal insulation characteristics as compared with prior art building block structures.

BACKGROUND OF THE INVENTION

The prior art has evolved a variety of building blocks which are capable of being interlocked together to construct buildings of various shapes and sizes. Prior art interlocking blocks typically utilize upwardly projecting webs which mate with recesses provided in the bases of identical blocks. The blocks are positioned on top of and in vertical interlocking relationship with each other. The prior art is exemplified, for example, in U.S. Pat. No. 3,888,060 issued June 10, 1975 for an invention of Juan Haener; U.S. Pat. No. 2,610,503 issued Sept. 16, 1952 for an invention of Clarence C. Hall; U.S. Pat. No. 3,247,633 issued Apr. 26, 1966 for an invention of Russell F. Schultz et al; U.S. Pat. No. 3,305,982 issued Feb. 28, 1967 for an invention of Oscar Murphy Steele; and, U.S. Pat. No. 3,618,279 issued Nov. 9, 1971 for an invention of T. F. Sease. However, such prior art building blocks rely either solely or heavily upon the mating relationship between the aforesaid upwardly projecting webs and recesses to interlock the blocks together. This is disadvantageous because shear forces acting perpendicular to a wall constructed of such prior art blocks may cause the upwardly protruding webs (which, of necessity, have a relatively small surface area, as compared with that portion of the surface area of the block from which the webs project) to shear away from the remainder of the block, unless a bonding agent such as mortar or grout is used to strengthen the bond between adjacent blocks. Moreover, unless bonding agents are used, such prior art blocks are not capable of resisting forces applied horizontally or vertically in the plane of a wall constructed with such prior art blocks, which may result in damage to or destruction of the wall.

The present invention provides a simplified structural block system in which a minimal number of different types of interlocking blocks may be utilized to construct a wide variety of buildings, without the need for mortar or other bonding agents. More particularly, the structural blocks of the invention enable the construction of buildings from parallel courses of blocks which are longitudinally and transversely interlocked together and which may further be vertically interlocked with additional courses of longitudinally and transversely interlocked blocks placed on top of lower courses of interlocked blocks.

SUMMARY OF THE INVENTION

The preferred embodiment of the invention provides a basic structural block comprising a longitudinally extending member having vertical inner and outer faces. A web is centred on and projects away from the inner face of the block and extends from top to bottom thereof along one half the longitudinal extent of the inner face of the block. Tongue and groove projections and recesses are provided on the inner face and on the web for mating with corresponding projections and recesses on identical blocks, whereby a plurality of such blocks may be longitudinally, transversely and vertically interlocked together.

The invention also provides a corner block which is similar to the basic block, but which is truncated at one longitudinal end thereof by an amount equal to the displacement between the inner and outer faces of the basic block (such displacement being identical for all blocks in the system except the pilaster and web blocks). The corner block further comprises a second web at its truncated end, projecting away from the inner face of the corner block and extending from top to bottom thereof. The second web has tongue and groove projections and recesses for mating with corresponding projections and recesses on the basic blocks. This enables the corner block to be interlocked with the basic block, with the outer faces of both blocks at 90° to one another, thus forming a corner.

The invention also provides a jamb block which is also similar to the basic block, but which has one longitudinal half thereof replaced by a rectangular butt for extending the displacement between the inner and outer faces of the butt to equal the displacement between the outer faces of a pair of opposed, longitudinally and transversely interlocked basic blocks. The jamb block may be positioned at the end of a course of basic blocks to frame a door, window or other wall aperture.

The invention also provides a pilaster block which is also similar to the basic block, but in which the displacement between the inner and outer block faces is greater than the corresponding displacement in the basic blocks. A vertical stack of pilaster blocks may be interlocked into a wall to form a structural pier or column to strengthen the wall or to support loads above the column.

The invention further provides a beam block which is also similar to the basic block, but in which the central, projecting web is truncated to extend from the bottom of the block only about one quarter to about one half the distance to the top of the block. This leaves a space above the web into which reinforcing material may be inserted, thereby facilitating construction of lintels or beams.

The invention further provides a junction block which is also similar to the basic block, but which has a right angled corner between its inner and outer faces. First and second tongue and groove bearing portions project, respectively, away from first and second right angled inner faces of the junction block. The junction block facilitates construction of "T" interconnected walls.

The invention also provides a web block which is also similar to the basic block but in which the aforementioned longitudinally extending member is truncated so that it extends only the width of the web, such that, when the web block is longitudinally and transversely interlocked with the basic blocks, the outer face of the web block will lie in the same plane as the innermost faces of the webs of the basic block. The web block facilitates construction of walls having reduced thickness, as compared with the thickness of walls constructed entirely of basic blocks.

A structural system according to the invention may comprise a plurality of basic blocks, a further plurality of half height basic blocks, and a selection of full and half height corner, jamb, pilaster, beam, junction and web blocks; depending upon the nature of the desired structure. The basic blocks may be longitudinally, transversely and vertically interlocked together to form a wall by alternately placing a first course of half height blocks in longitudinally and transversely interlocked relation with a second, parallel, opposed course of full height basic blocks, with the inner faces of each course of blocks facing one another, thereby forming a base for the wall. The base will have a staggered upper surface comprised, along one side of the upper surface, of the tops of the half height blocks; and, along the parallel, opposed side of the upper surface, of the tops of the full height blocks. Full height basic blocks are then interlocked longitudinally, transversely and vertically with the previously placed blocks, by alternately stacking the full height basic blocks along the upper surface of the first course of half height blocks and then above the second course of full height blocks, to a desired height of the wall. Finally, a course of half height blocks is placed in longitudinally overlapped, interlocking relation with the uppermost course of full height blocks, to provide a level upper surface for the wall.

The displacement between the inner and outer faces of the blocks and/or the distance by which the webs project from the inner faces of the blocks may be varied to provide blocks of any desired thickness, thereby facilitating the construction of walls of any desired thickness.

Advantageously, the blocks are vertically apertured to reduce the weight of the blocks and to permit insertion of reinforcing or other material through vertical stacks of blocks, which may be desired in some cases.

Vertical apertures are also preferably provided in the blocks, adjacent their outer faces, such that the vertical apertures of one course of blocks will be in air communication with corresponding vertical apertures of a course of blocks interlocked above or below said one course. This enables air to circulate through the blocks, adjacent the outer surface of the wall, and provides thermal isolation between the inner and outer surfaces of the wall of a building constructed with the blocks.

DETAILED DESCRIPTION OF THE DRAWINGS

Figure 11:
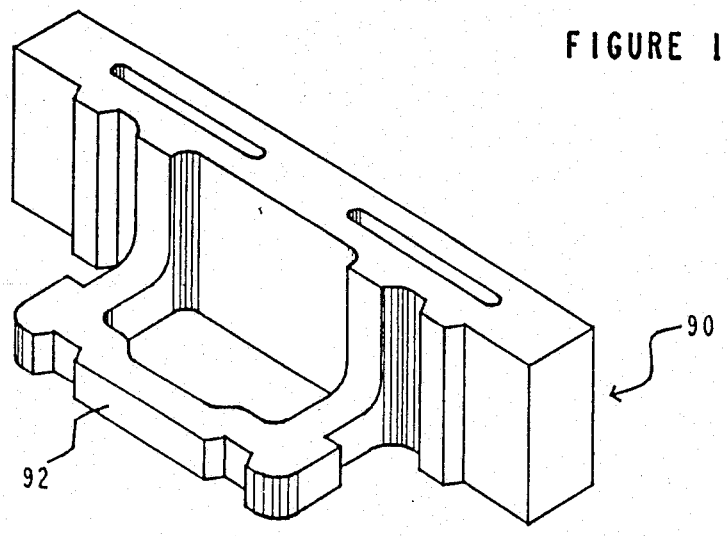
Figure 12:
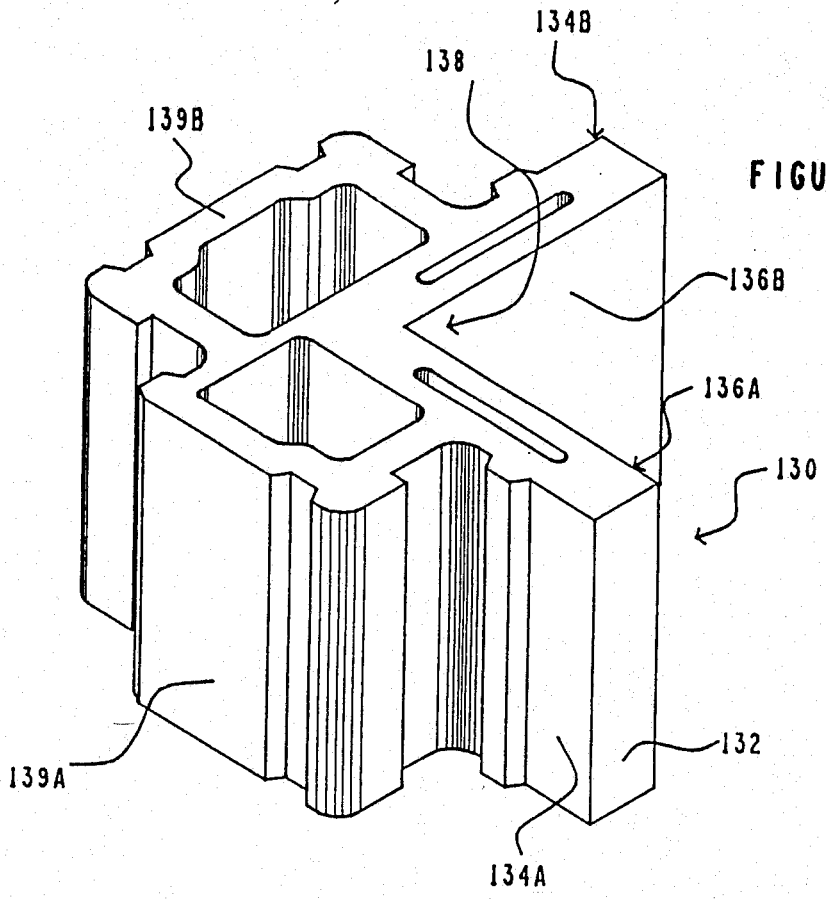
Figure 13:
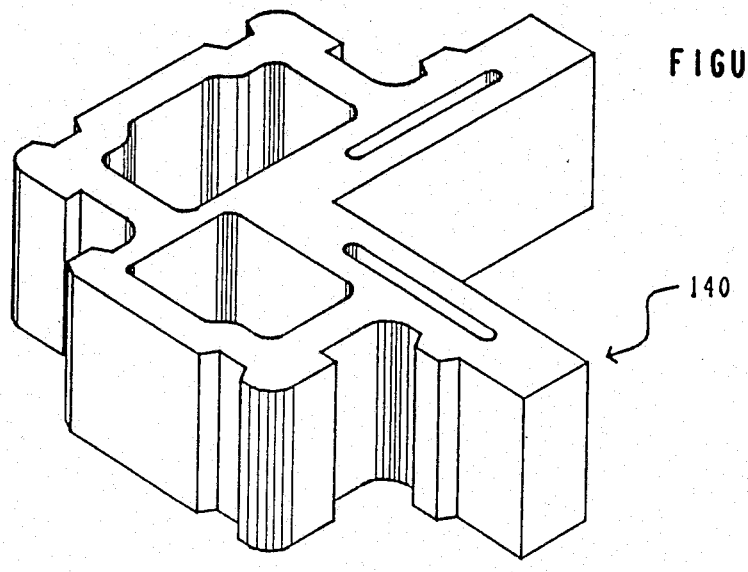
Figure 14:
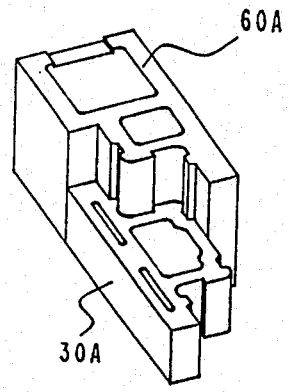
Figure 15:
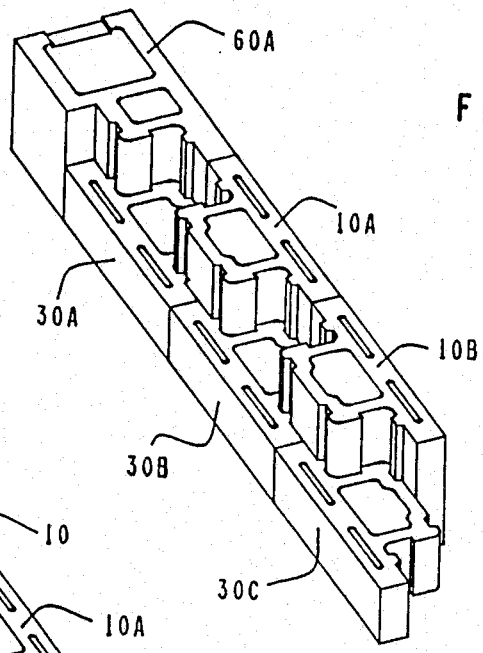
Figure 16:
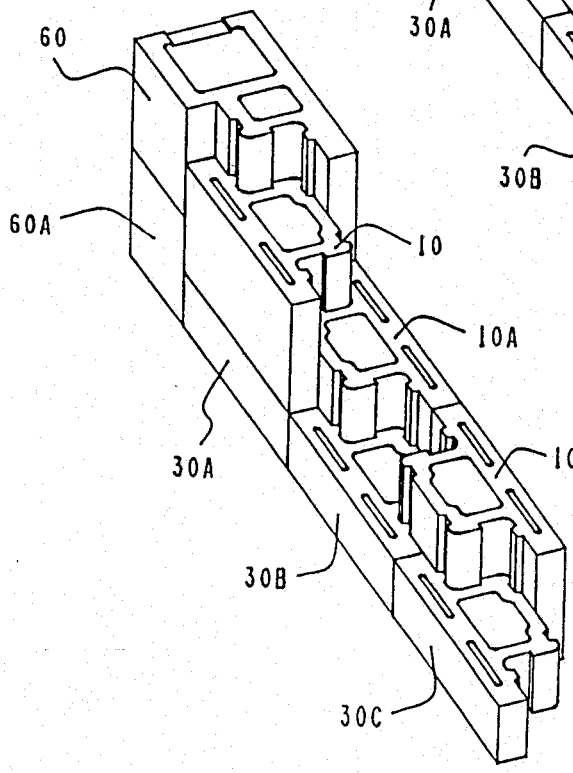
Figure 17:
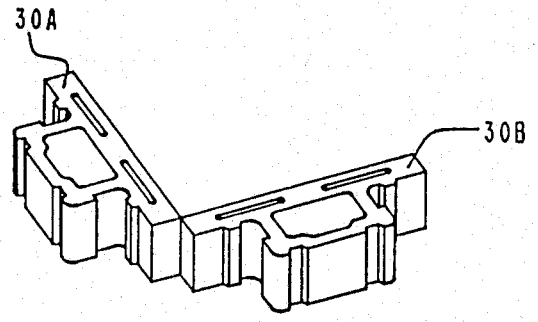
Figure 18:
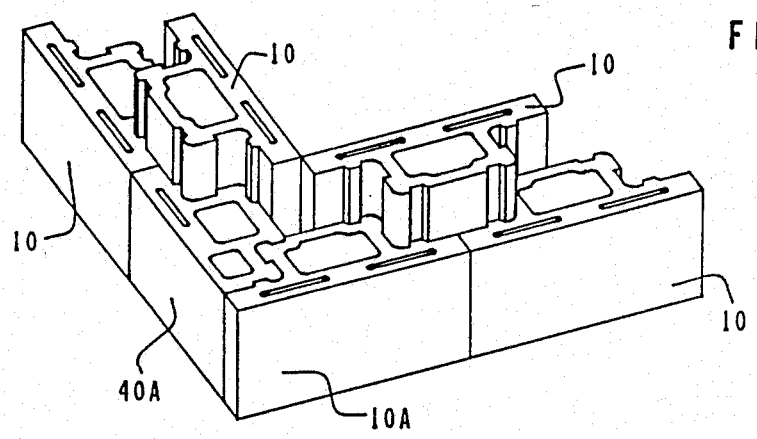
Figure 19:
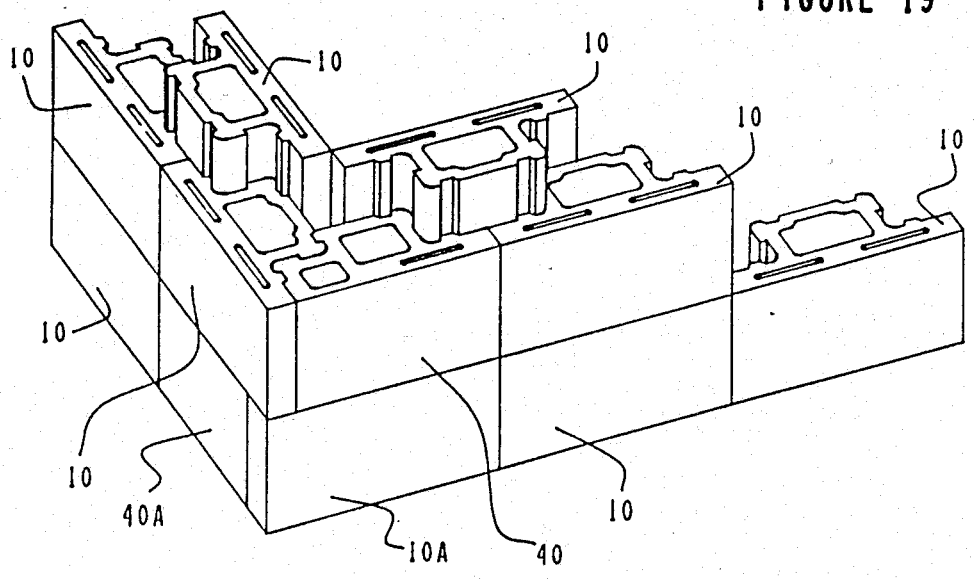
Figure 24:
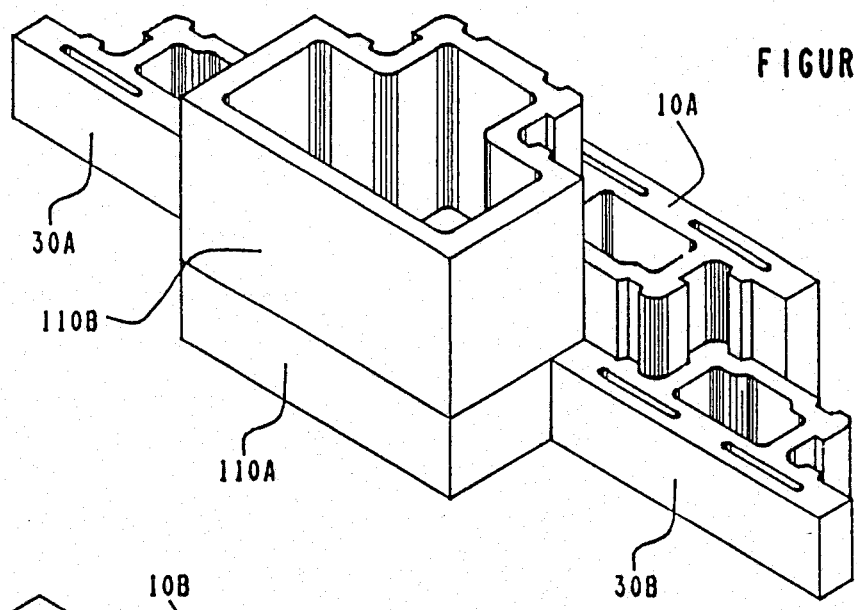
Figure 25:
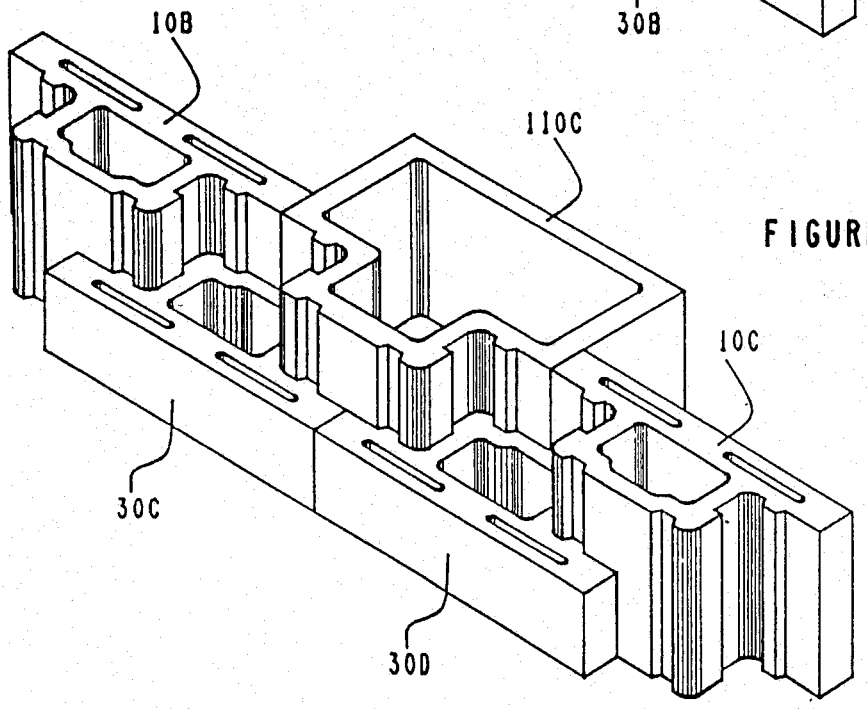
Figure 26:
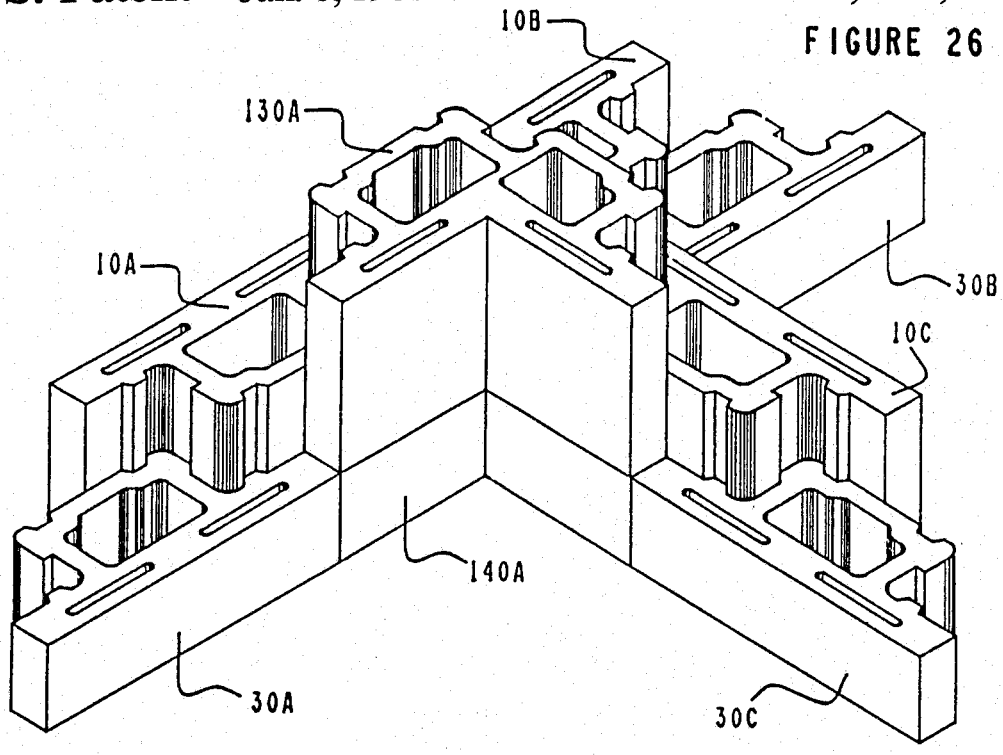
Figure 27:
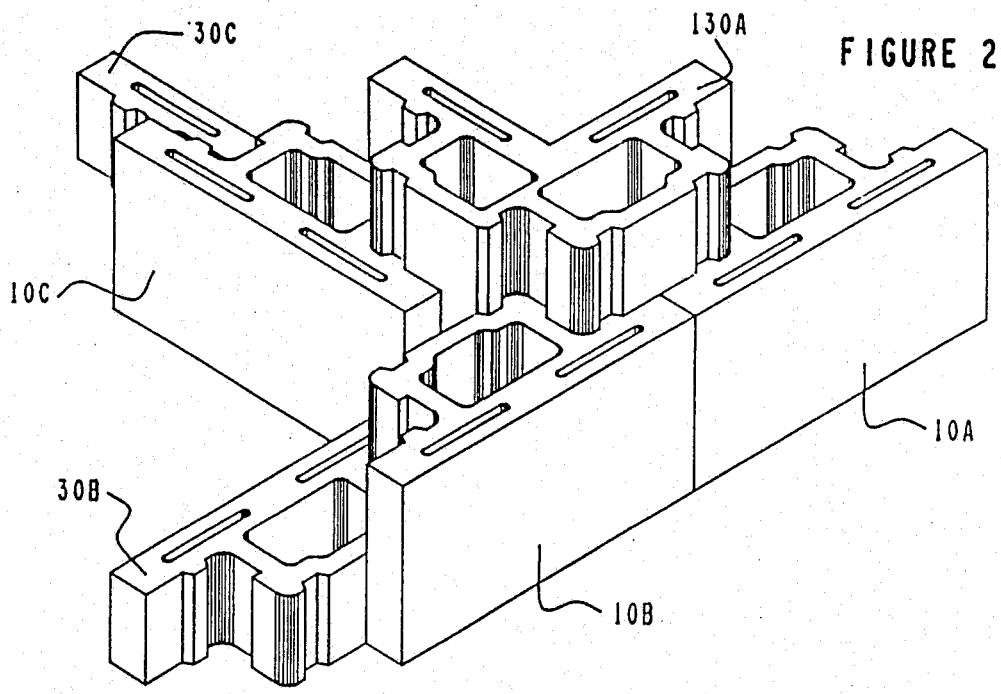

FIG. 11 a perspective view of a half height beam block according to the invention;

FIG. 12 is a perspective view of a full height junction block according to the invention;

FIG. 13 is a perspective view of a half height junction block according to the invention;

FIGS. 14 through 16 illustrate how the jamb, basic and half height basic blocks may be interlocked together to form a wall having a jamb at one end thereof;

FIGS. 17 through 19 illustrate how the full and half height corner and basic blocks may be interlocked together to construct a wall having a 90° corner;

FIGS. 20 through 23 illustrate how the full and half height basic and beam blocks may be interlocked together to form a lintel or beam;

FIGS. 24 and 25 illustrate how the full and half height pilaster and basic blocks may be interlocked together to provide a structural pier or column interconnected to a wall;

FIG. 26 illustrates how the full and half height junction and basic blocks may be interlocked together to form a pair of "T" interconnected walls;

FIG. 27 shows the interlocked blocks of FIG. 26, as viewed from the opposite side of the wall which forms the crosspiece of the "T".

Figure 28:
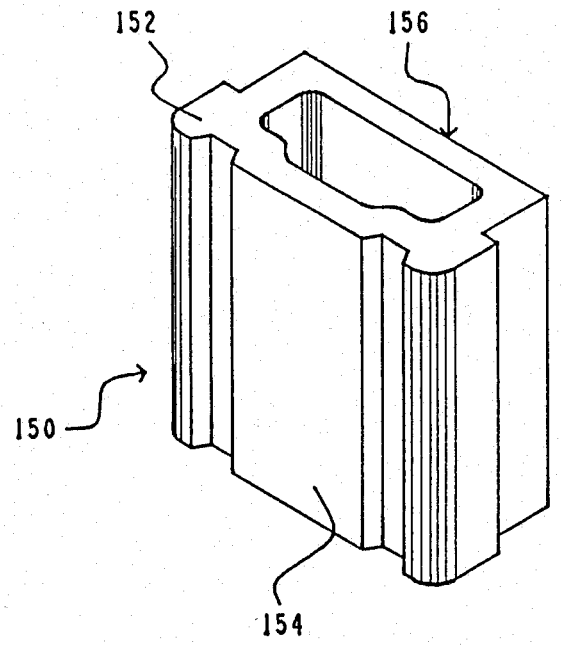
Figure 29:
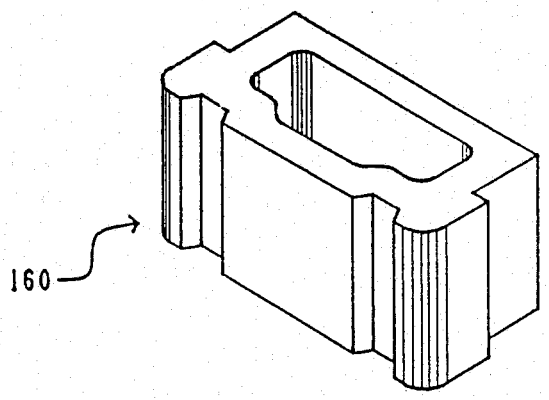
Figure 30:
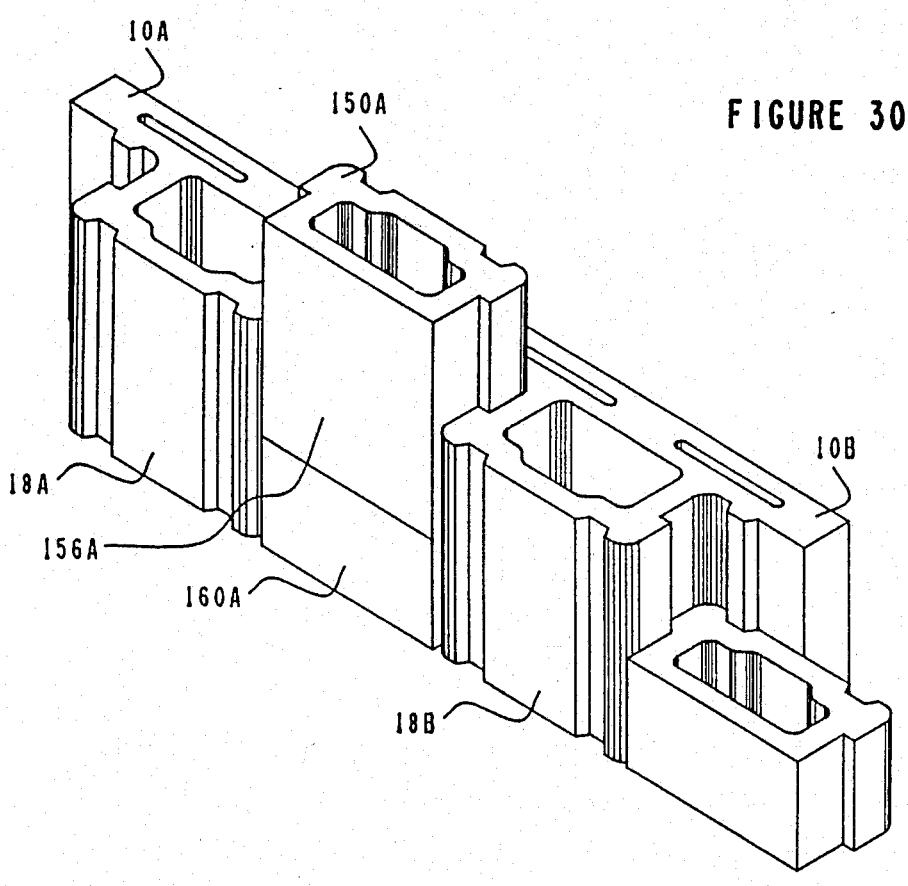

FIG. 28 is a perspective view of a full height web block in accordance with the invention;

FIG. 29 is a perspective view of a half height web block in accordance with the invention; and, FIG. 30 illustrates how the full and half height web and basic blocks may be interlocked together to provide a wall of reduced thickness.

DETAILED DESCRIPTION OF THE PREFERRED EMBODIMENT

Basic Structural Block

Figure 1:
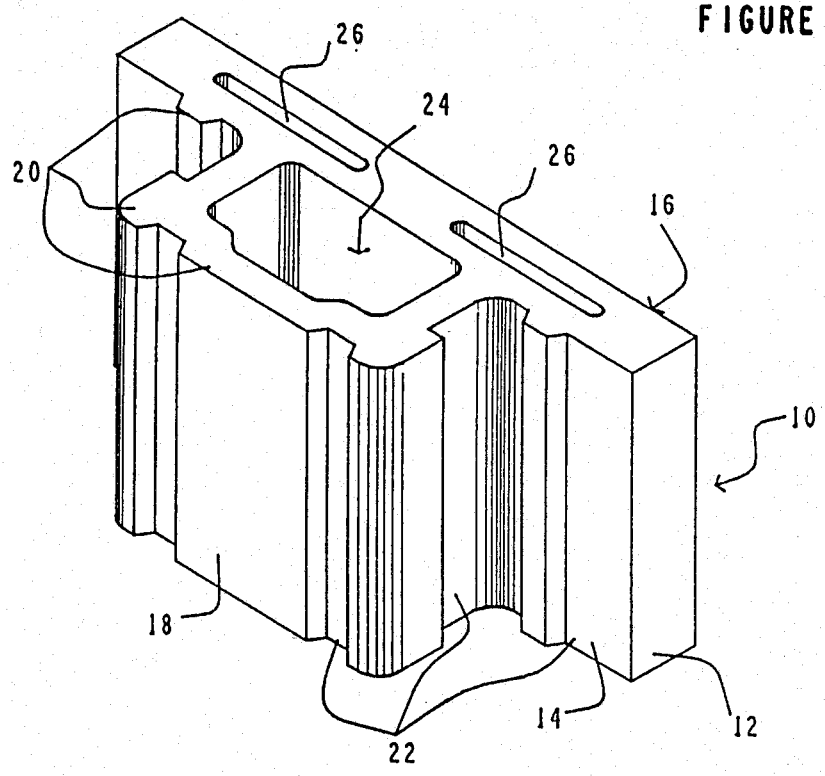
FIG. 1 is a perspective view of a full height basic structural block according to the invention.

FIG. 1 provides a perspective view of a basic structural block 10 according to the invention. Block 10, which is preferably made from concrete, comprises a longitudinally extending member 12 having opposed vertical inner and outer faces 14, 16 respectively. A web 18 is centred on and projects away from inner face 14 and extends from top to bottom of block 10 along one half the longitudinal extent of inner face 14. Tongue and groove type projections 20 and recesses 22 are provided on inner face 14 and on web 18 for mating with corresponding projections and recesses on other blocks in the manner hereinafter described. This enables a plurality of blocks 10 to be longitudinally, transversely and vertically interlocked together, with inner faces of alternate blocks facing one another, as hereinafter described.

Figure 2:
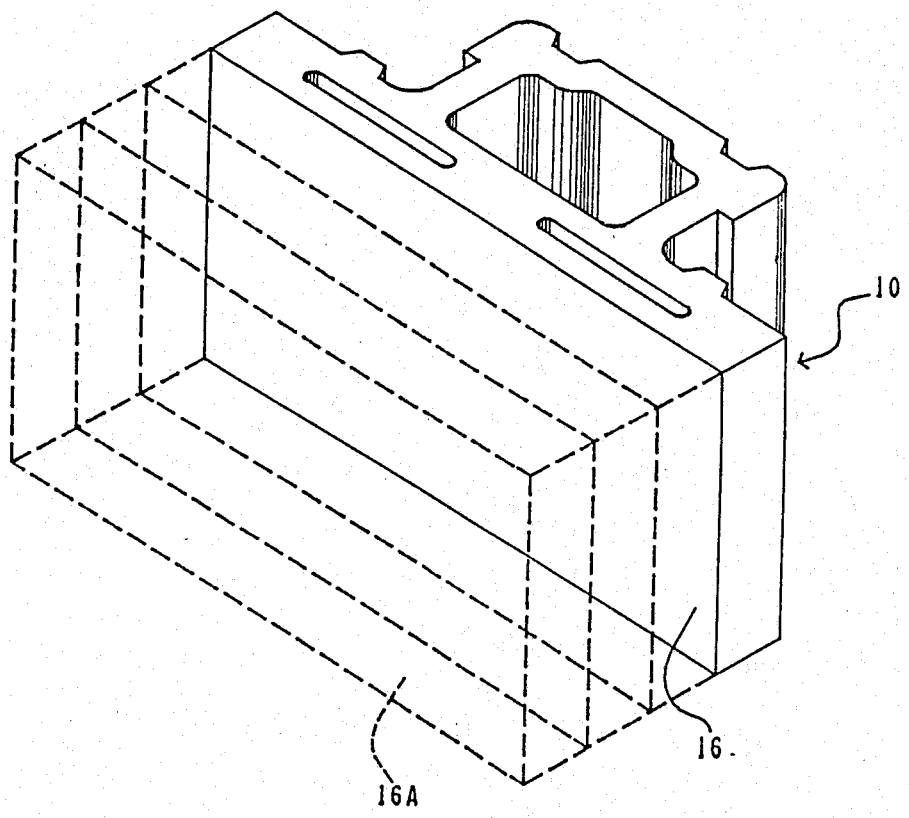
FIG. 2 illustrates how the thickness of the block of FIG. 1 may be varied.

The inventor has found that the "jigsaw" puzzle shaped pattern of interlocking projections and recesses 20, 22 illustrated in FIG. 1 is uniquely adapted to the construction of a system of interlocking building blocks as hereinafter described. It should however be understood that the displacement between inner and outer faces 14, 16 of block 10 (and of all of the other blocks hereinafter described) is variable, as is the distance by which web 18 projects from inner face 14 of block 10. FIG. 2 illustrates, for example, how block 10 may be extended by adding material on outer face 16 to extend the thickness of block 10 by any desired amount. This is illustrated by hidden lines in FIG. 2 and by reference numeral 16A which denotes an extended outer face of block 10. Those skilled in the art will further understand that outer faces 16 or 16A of block 10 may be textured or otherwise provided with decorative or acoustical dampening materials and configurations.

Web 18 is preferably provided with a vertical aperture 24 (FIG. 1) which extends through block 10 from top to bottom. Besides reducing the weight of block 10, aperture 24 facilitates the insertion of reinforcing material, insulating material, mechanical or electrical service conduits, etc. through a plurality of aligned apertures in a sequence of vertically interlocked blocks.

Block 10 preferably also includes at least one aperture 26 (two such apertures being illustrated in FIG. 1) which also extends vertically through block 10 from top to bottom between inner and outer faces 14, 16. Apertures 26 (which preferably take the form of extended, narrow slots, as illustrated in FIG. 1) are located relatively close to block outer face 16 and are positioned such that apertures 26 of one block will be in air communication with corresponding apertures of other blocks vertically interlocked above or below said one block as hereinafter described. This assists in the establishment of a thermally insulative barrier between the inner and outer surfaces of a wall constructed with a plurality of blocks 10 in the manner hereinafter described. Apertures 26 further contribute to the equalization of differential air pressure which may exist between the inner and outer faces of a wall constructed with blocks 10. Apertures 26 also enhance the capability of blocks 10 to withstand fire by circulating air which tends to cool the outer walls of a structure formed of such blocks and thus improves the structure's capability to resist thermal shock as, for example, when a fire hose is trained upon the outer wall of a structure inside which a fire is burning.

Figure 3:
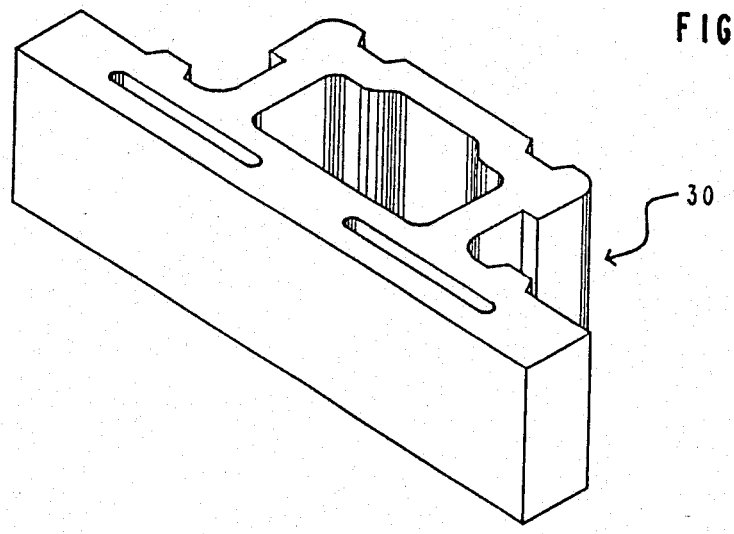
FIG. 3 is a perspective view of a half height basic structural block according to the invention.

FIG. 3 illustrates a structural block 30 which is identical to basic block 10 of FIG. 1, except that block 30 is only half the height of block 10.

Construction with Basic Blocks

Figure 4:
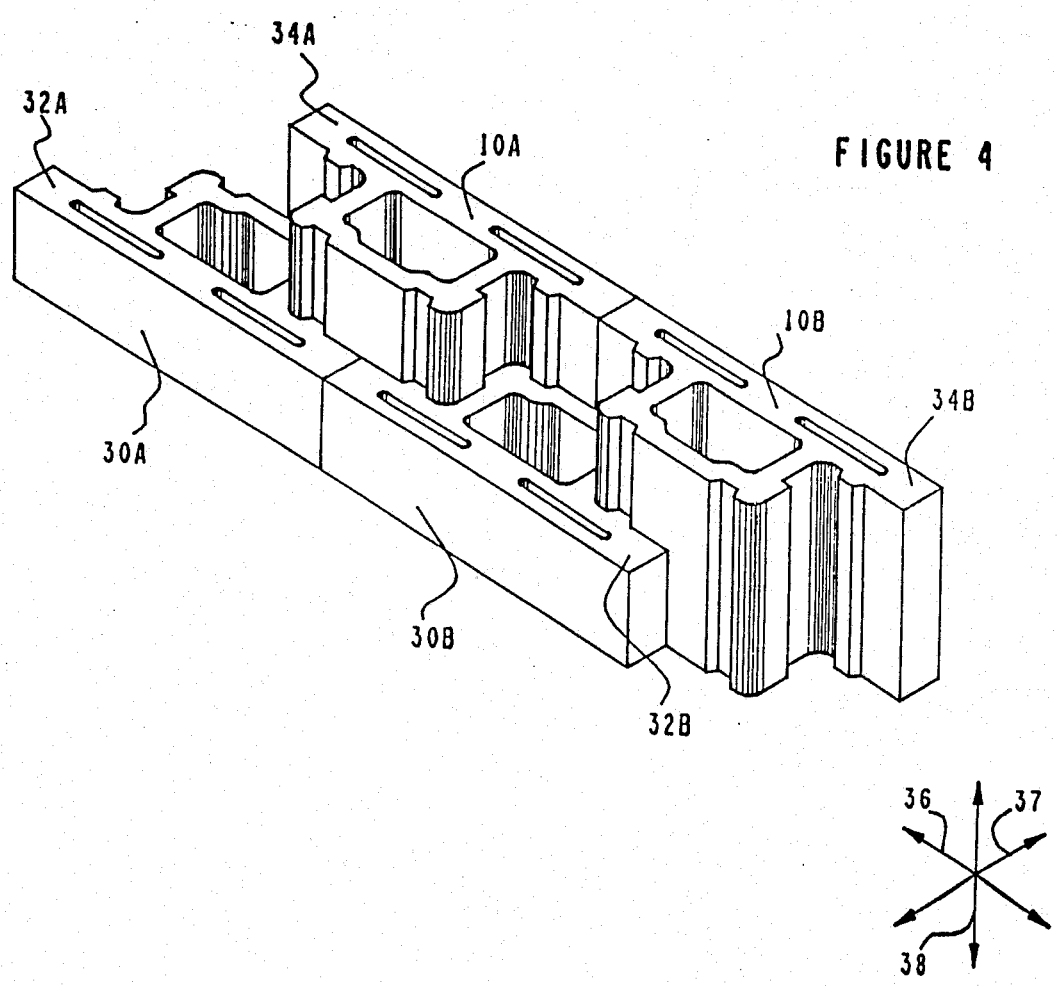
FIG. 4 illustrates how the blocks of FIGS. 1 and 3 may be longitudinally and transversely interlocked together.

FIG. 4 illustrates how a plurality of full height blocks 10A, 10B, etc. and half height blocks 30A, 30B, etc. may be combined to construct a wall in which the blocks are longitudinally, transversely and vertically interlocked together. As used herein the term "longitudinally interlocked" refers to the capability to resist forces in either of the directions indicated in FIG. 4 by double-headed arrow 36. Similarly, the terms "transversely interlocked" and "vertically interlocked" refer, respectively, to the capability to resist forces in the directions indicated in FIG. 4 by double-headed arrows 37 and 38.

More particularly, FIG. 4 illustrates how a half height block 30A may be longitudinally and transversely interlocked in overlapped relation with a full height block 10A, with the inner faces of blocks 30A and 10A facing one another. This is accomplished by placing one or the other of blocks 10A or 30A upon a surface, then aligning the projections and recesses of the other block over the corresponding mating recesses and projections of the first block, then sliding the second block down so that the recesses and projections of both blocks interlock as shown. A second half height block 30B may then be placed, as shown, in longitudinal, end to end relationship with half height block 30A and in longitudinally and transversely interlocking relation with full height block 10A. Then, a second full height block 10B may be placed, as shown, in longitudinal, end to end relation with full height block 10A and in longitudinally and transversely interlocking relation with half height block 30B. A parallel opposed pair of longitudinally and transversely interlocked courses of half and full height blocks may thus be extended to any desired length by interlocking placement of additional half height and full height blocks to the right and/or left of those illustrated in FIG. 4, thereby forming a base for a wall. As may be seen in FIG. 4, the base of the wall has a staggered upper surface comprised, along one side of the upper surface, of the tops 32A and 32B of the first course of half height blocks 30A and 30B respectively; and, further comprised, along the parallel opposed side of the upper surface of the base of the wall, of the tops 34A and 34B of the second course of full height blocks 10A and 10B.

Construction of the wall may then proceed by alternately stacking full height blocks along the upper surface formed by the tops 32A, 32B, etc. of the first course of half height blocks 30A, 30B, etc. so as to longitudinally, transversely and vertically interlock the lower halves of the newly stacked full height blocks in longitudinal overlapping relationship with the portions of full height blocks lOA, lOB which may be seen projecting above blocks 30A, 30B in FIG. 4. An opposed course of full height blocks may then be stacked along the upper surface formed by the tops 34A, 34B, etc. of the second course of blocks 10A, 10B, etc. to longitudinally, transversely and vertically interlock the lower halves of those newly stacked blocks in longitudinally overlapped relationship with the upper projecting halves of the course of full height blocks stacked on top of the first course of half height blocks 30A, 30B, etc. Construction of the wall continues in this manner, leaving a staggered upper surface along the tops of opposed courses of interlocked blocks, until the wall reaches its desired height. A final course of half height blocks is then positioned along the tops of the lower of the two uppermost courses of full height blocks so as to level the top surface of the wall. The resultant wall is securely interlocked longitudinally, transversely and vertically and thus is able to withstand forces of the sort mentioned above which may damage or destroy structures formed of prior art blocks. Accordingly, structures formed of the blocks of the invention have improved longevity as compared with structures formed of prior art blocks. Moreover, structures formed of the blocks of the invention are better able to withstand fire and have improved accoustical isolation as compared with structures formed of prior art blocks, because the discontinuous material surface between transversely opposed blocks forms a barrier to the penetration of fire or sound.

Corner Block

Figure 5:
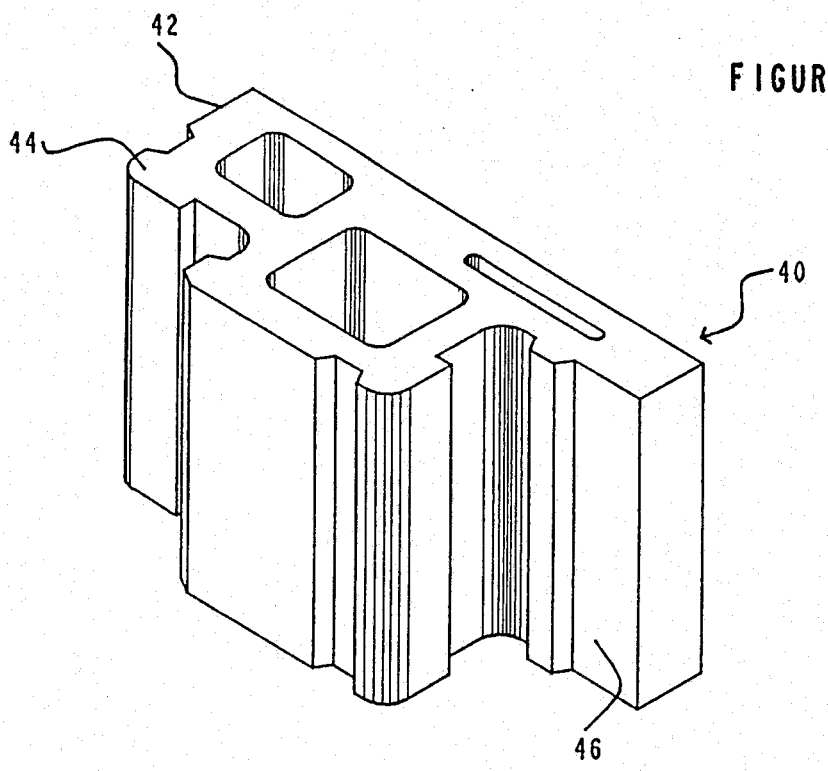
FIG. 5 is a perspective view of a full height corner block in accordance with the invention.
Figure 7:
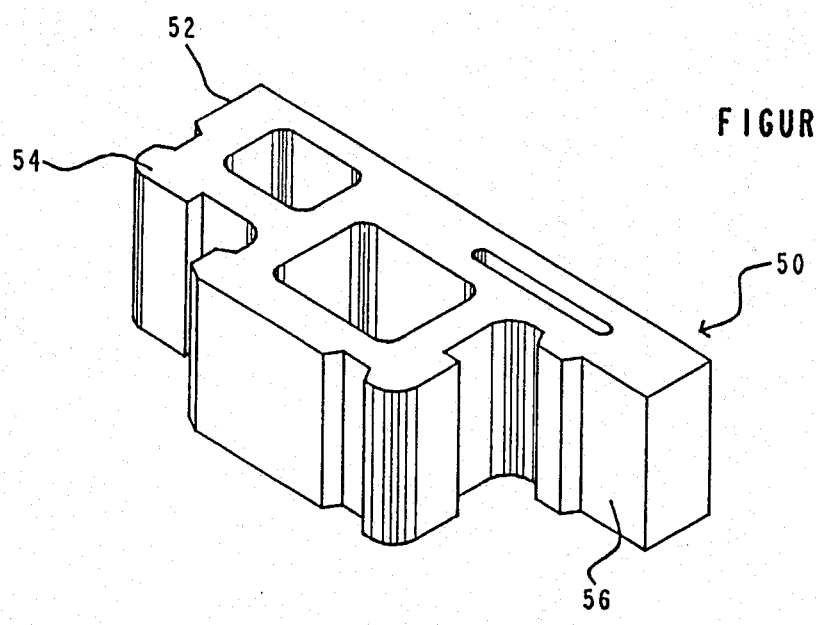
FIG. 7 is a perspective view of a half height corner block in accordance with the invention.

FIGS. 5 and 7 illustrate full and half height "corner" blocks 40 and 50 respectively, which may be interlocked with the basic blocks described above to form 90° corners. Corner blocks 40 and 50 are similar to basic blocks 10 and 30 respectively, except that corner blocks 40 and 50 are truncated at their ends 42, 52 by an amount equal to the displacement between inner and outer faces 14, 16 of basic blocks 10 or 30. Furthermore, corner blocks 40 and 50 are provided with a second web 44, 54 respectively at truncated ends 42, 52. Second webs 44, 54 project away from the inner faces 46, 56 of blocks 40, 50 and extend from top to bottom of blocks 40, 50 respectively. Second webs 44, 54 are further provided with tongue and groove projections and recesses similar to and for mating with those provided on blocks 10, 30.

Construction of Corners

FIGS. 17, 18 and 19 illustrate the use of corner block 40 in conjunction with the full and half height basic blocks. More particularly, FIG. 17 illustrates how a pair of half height basic blocks 30A and 30B may be positioned to form a corner with the outer faces of blocks 30A, 30B at right angles to one another. The bases of a pair of right angled walls may then be constructed by laying a plurality of half height basic blocks 30 to the right of block 30B shown in FIG. 17 and by laying a further plurality of half height basic blocks 30 in longitudinal end to end relationship with block 30A shown in FIG. 17, as described above with reference to FIG. 4.

As may be seen in FIG. 18, a full height basic block 10A is placed in longitudinally and transversely interlocked relation with half height corner block 30B of FIG. 17 (block 30B is obscured from view in FIG. 18 by blocks stacked on top and in front of it), in the manner described above with reference to FIG. 4. The recesses and projections of full height corner block 40A are then aligned over the corresponding mating projections and recesses of half height block 30A and full height block 10A. Corner block 40A is then allowed to slide down so that it interlocks both longitudinally and transversely with blocks 30A and 10A, as shown in FIG. 18 (block 30A is also obscured from view in FIG. 18 by blocks stacked on top and in front of it), and further is in 90° opposed interlocking relation with the left hand end of full height basic block 10A as viewed in FIG. 18.

By comparing FIGS. 1, 4, 5, 17 and 18 those skilled in the art will understand how the aforesaid longitudinal truncation of corner block 40 and provision of second web 44 cooperate with mating portions of basic block 10 to form a 90° corner rigidly interlocked with adjacent and vertically staggered blocks. Construction of the right angled wall proceeds as illustrated in FIGS. 18 and 19 by interlocking placement of additional full height blocks 10 and corner blocks 40. Note that corner blocks 40A, 40 are vertically staggered on opposite sides of the corner as illustrated in FIG. 19 to yield an overlapped, rigidly interlocked corner structure.

Jamb Block

Figure 6:
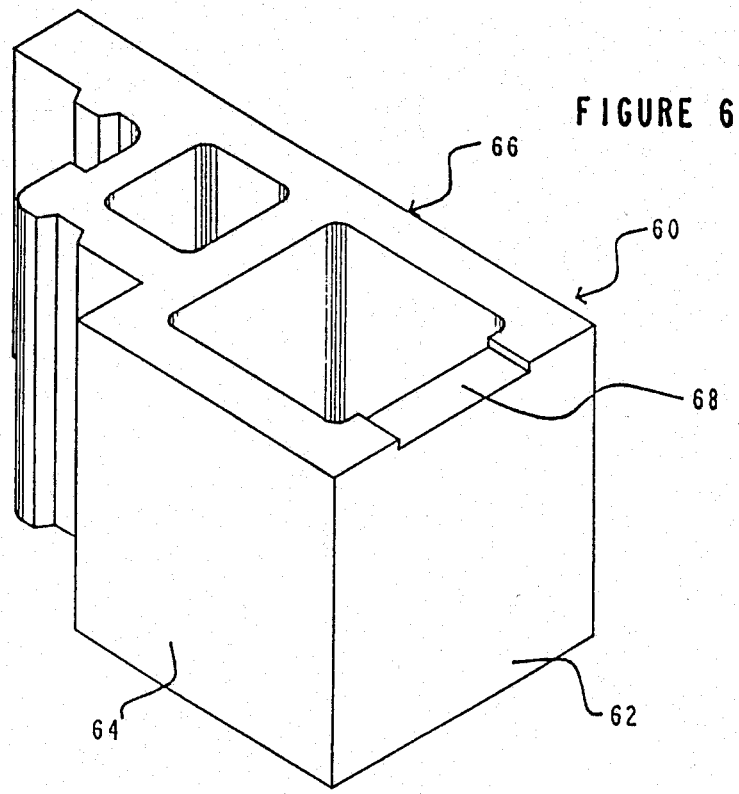
FIG. 6 is a perspective view of a full height jamb block in accordance with the invention.
Figure 8:
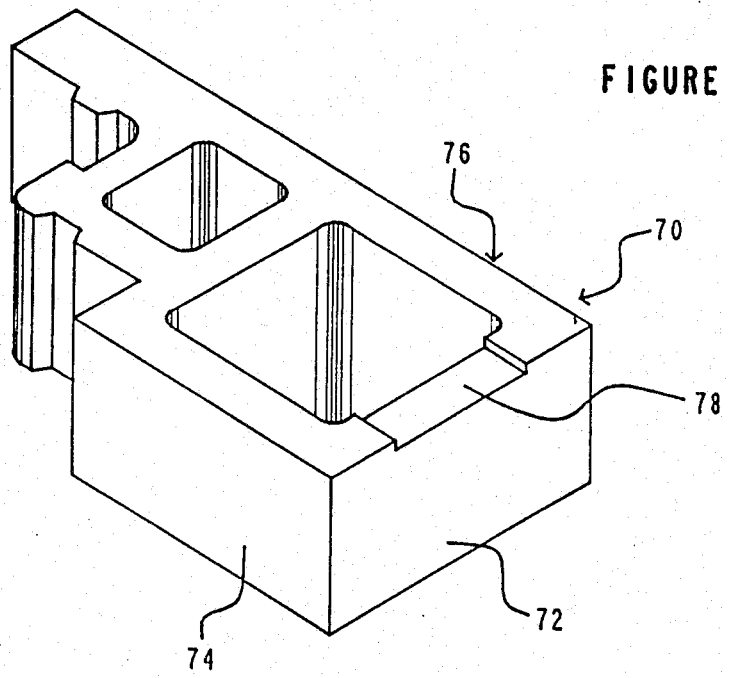
FIG. 8 is a perspective view of a half height jamb block in accordance with the invention.

FIGS. 6 and 8 illustrate full and half height "jamb" blocks 60 and 70 respectively, which may be interlocked with the other structural blocks herein described to form door jambs, or to frame windows or other wall apertures. Jamb blocks 60, 70 are similar to basic blocks 10 and 30 respectively, except that one longitudinal half of each of the basic blocks is replaced by a rectangular butt portion 62, 72 which extends the displacement between the inner faces 64, 74 and the outer faces 66, 76 respectively to equal the transverse displacement between the outer faces of a pair of longitudinally and transversely interlocked basic blocks such as blocks 10B and 30B illustrated in FIG. 4. This provides a squared termination for a course of blocks as will now be described with reference to FIGS. 14, 15 and 16.

Construction of Door Jambs, Window Frames, etc.

FIG. 14 illustrates the placement of a full height jamb block 60A in longitudinally and transversely interlocking relation with a half height basic block 30A. FIG. 15 illustrates how additional half height blocks 30B, 30C, etc. and full height blocks 10A, 10B, etc. may be added in the manner described above with reference to FIG. 4 to form a base of a wall extending downwardly to the right of jamb block 60A as viewed in FIG. 15. Construction of the wall then proceeds as illustrated in FIG. 16 and as described above, through the addition of further full height blocks 10 and jamb blocks 60 until the wall reaches its desired height. The vertically aligned, flat, butt ends of jamb blocks 60 form a smooth, vertical end surface of the wall which may serve as a portion of a door jamb, window frame, etc. Notches 68, 78 (FIGS. 6 and 8) are provided in jamb blocks 60 and 70 respectively to receive anchor elements conventionally provided in pre-manufactured door and window frames, etc. The anchor elements protrude through notches 68, 78 into the large central apertures of blocks 60, 70 which apertures may then be filled with grout or other hardenable material to hold the anchor elements and their associated frames securely in place.

Pilaster Block

Figure 9:
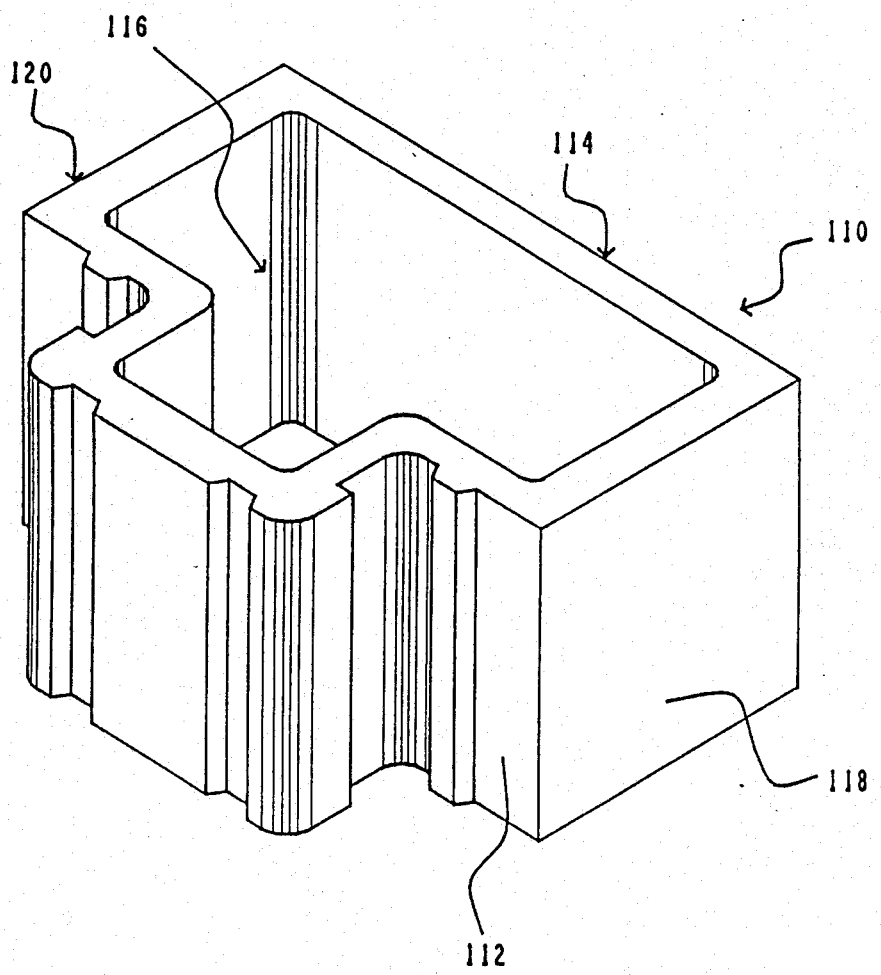
FIG. 9 is a perspective view of a full height pilaster block in accordance with the invention.

FIG. 9 illustrates a full height "pilaster" block 110. A pair of half height pilaster blocks (not shown separately) may be constructed by dividing full height pilaster block 110 along a plane midway between and parallel to the top and bottom surfaces of block 110. Pilaster block 110 is similar to basic block 10, except that the transverse displacement between inner and outer faces 112, 114 of pilaster block 110 is extended with respect to the transverse displacement between inner and outer faces 14, 16 of basic block 10. This is accomplished by providing an enlarged aperture 116 within pilaster block 110 (as may be seen in FIG. 9) and by extending the side walls 118, 120 of pilaster block 110. Note that there is no need, in pilaster block 110, for apertures corresponding to air communication apertures 26 of basic block 10, since extended aperture 116 of pilaster block 110 may be configured to ensure adequate thermal isolation and air pressure equalization between the inner and outer walls 112, 114 of pilaster block 110. Pilaster block 110 facilitates the construction of structural piers or columns which may be interconnected with walls formed of the various other blocks included in the structural system of the invention, as will now be described with reference to FIGS. 24 and 25.

Construction of Structural Piers and Columns

FIG. 24 shows a pair of half height basic blocks 30A and 30B placed on longitudinally opposed sides of a half height pilaster block 110A. A pair of full height basic blocks (only one of which, namely block 10A, is visible in FIG. 24) are then longitudinally and transversely interlocked with blocks 30A, 30B and 110A. A full height pilaster block 110B is then placed on top of half height pilaster block 110A and in longitudinally, transversely and vertically interlocking relation with the aforementioned full height basic blocks. Construction proceeds in the manner aforesaid by interlocking placement of additional full height basic blocks on top of the courses of full and half height basic blocks previously placed, and by interlocking placement of additional full height pilaster blocks on top of the pilaster blocks previously placed, until the wall and column reach their desired height, after which a final course of half height basic blocks is added, as described above, to level the top surface of the wall.

It will be noted that the extended side walls and outer face of pilaster blocks 110A, 110B, etc. protrude out from the wall, thus providing an enlarged cross-sectional area for the column comprising the vertically aligned pilaster blocks and consequential supportive strength for the adjacent interconnected wall sections or for loads which may be placed above the column. If desired, grout or other suitable hardenable material may be injected into the vertically aligned apertures of a column of pilaster blocks to provide further strength.

FIG. 25 shows an alternate technique for constructing an interconnected wall and column in which the resultant column protrudes from the side of the wall on which full height basic blocks form the lowest course of blocks (by contrast, the column formed by pilaster blocks 110A, 110B in FIG. 24 protrudes from the side of the wall on which half height basic blocks form the lowest course of blocks). As may be seen in FIG. 25, construction begins by placement of a full height pilaster block 110C between full height basic blocks 10B and 10C. Half height basic blocks 30C and 30D are then placed in longitudinally and transversely interlocking relationship with blocks 10B, 10C and 110C as shown in FIG. 25. Construction proceeds as aforesaid until the wall and column reach their desired height, after which a final course of half height basic blocks and a half height pilaster block are added (above blocks 10B, 10C and 110C, etc.) to level the top surface of the wall.

Beam Block

Figure 10:
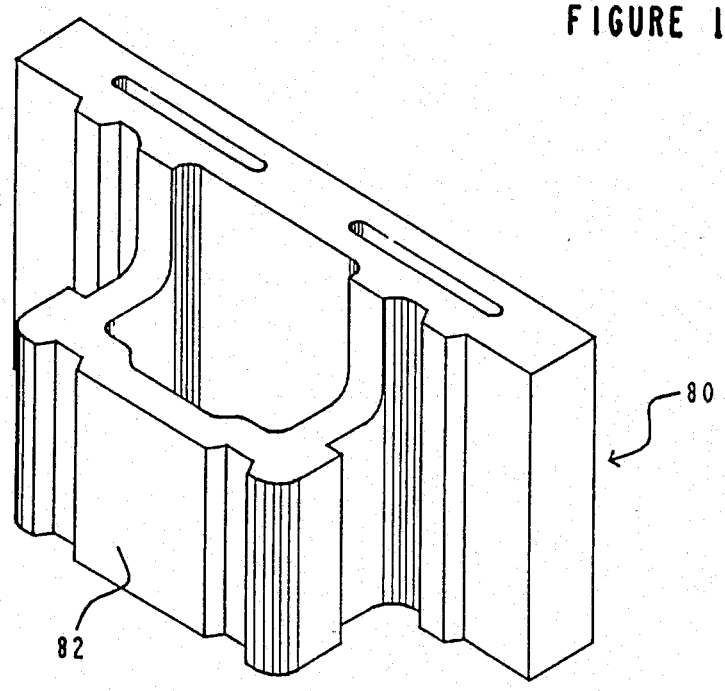
FIG. 10 is a perspective view of a full height beam block according to the invention.

FIGS. 10 and 11 illustrate full and half height "beam" blocks 80 and 90, respectively. Beam blocks 80, 90 are identical to basic blocks 10, 30 respectively, except that the centrally protruding webs of blocks 10 and 30 are truncated so that, in beam blocks 80 and 90 respectively, webs 82 and 92 extend from the bottom of blocks 80, 90 only roughly one quarter to one half the distance to the tops of blocks 80, 90. This facilitates the placement of reinforcing material, insulating material, mechanical or electrical services, etc. along a longitudinal aperture in the space above the webs of a series of longitudinally aligned beam blocks 80 or 90 to construct a lintel or horizontal beam as will now be described with reference to FIGS. 20 through 23.

Construction of Lintels and Beams

Figure 20:
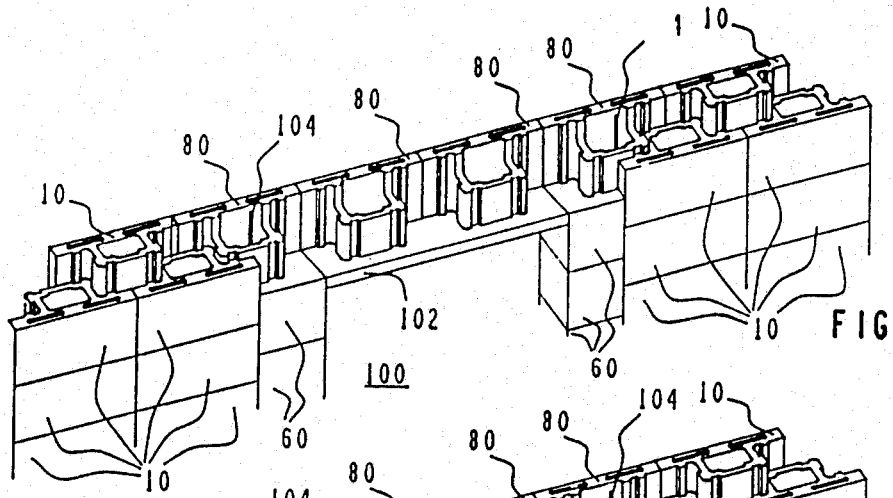
Figure 21:
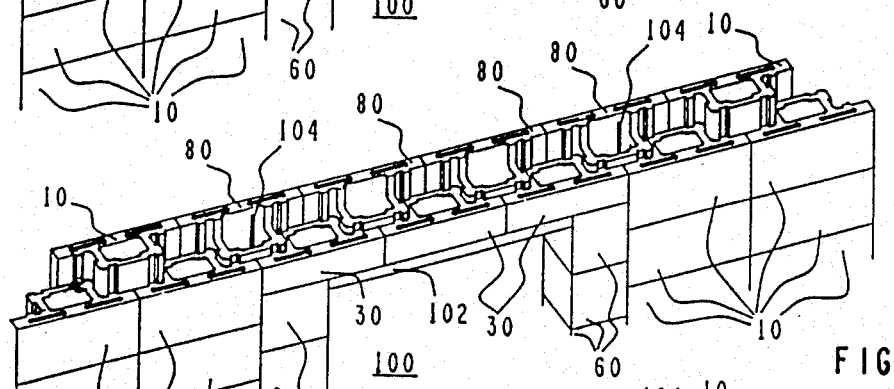

FIG. 20 illustrates a wall constructed with full height basic and jamb blocks 10, 60 to form a wall aperture 100 beneath a piece of temporary form work 102. A course of full height beam blocks 80 is laid along the top of form work 102 and jamb blocks 60 as illustrated in FIG. 20. Since webs 82 of beam blocks 80 have tongue and groove projections and recesses identical to those of basic blocks 10; blocks 10 and 80 interlock both longitudinally and transversely in the manner hereinbefore described.

Figure 22:
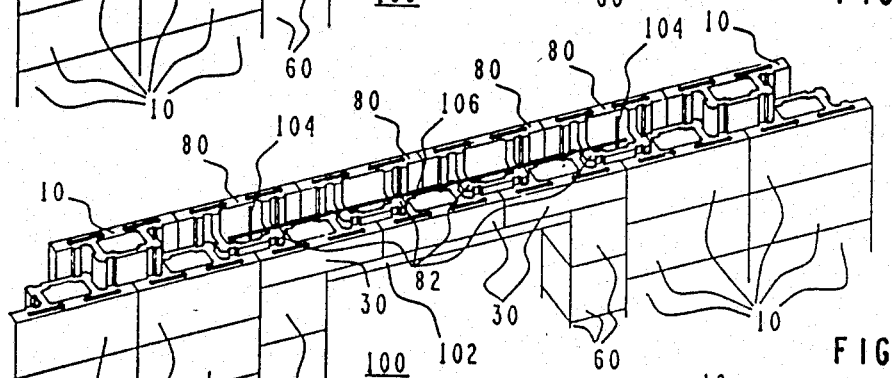
Figure 23:
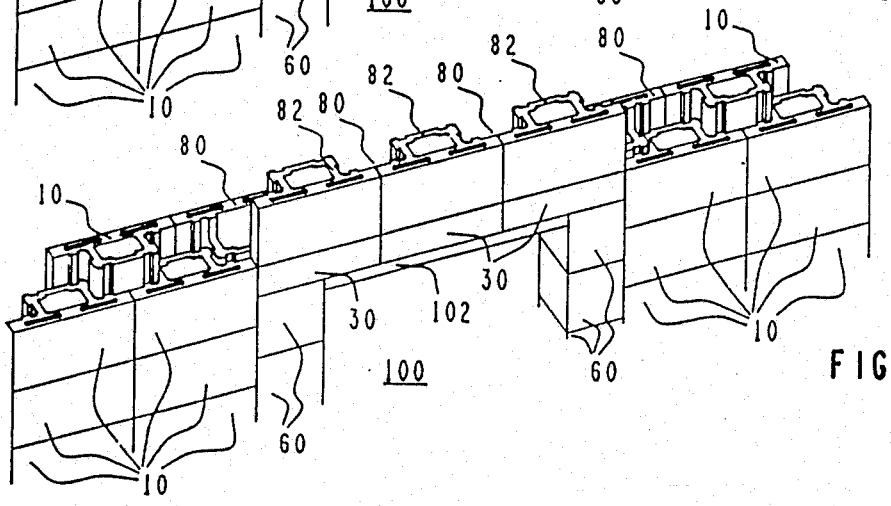

Reinforcing rods or other suitable reinforcing material 104 may then be passed through the central apertures of beam blocks 80 positioned above jamb blocks 60 to project downwardly through the vertically aligned apertures of jamb blocks 60 as shown in FIG. 20. A course of half height basic blocks 30 is then interlocked with beam blocks 80, above form work 102, in the manner illustrated in FIG. 21. Reinforcing material 106 is then placed longitudinally along the tops of truncated webs 82 of beam blocks 80 as illustrated in FIG. 22. Reinforcing material 106 is then covered by placing a course of inverted beam blocks 80 above half height basic blocks 30 as may be seen in FIG. 23. This leaves reinforcing material 106 in a longitudinal space between the upper surface of webs 82 of beam blocks 80 shown in FIG. 20, and the lower surfaces of webs 82 of beam blocks 80 positioned on top of half height blocks 30 as shown in FIG. 23. Grout or other suitable hardenable material is then injected into the longitudinal space just described to form a solid longitudinal beam above aperture 100. After the grout or other material has cured, temporary form work 102 may be removed.

Junction Block

FIGS. 12 and 13 illustrate full and half height "junction" blocks 130 and 140 respectively, which may be interlocked with the full and half height basic blocks described above to form a pair of "T" interconnected walls. By comparing FIGS. 1 and 12 it will be seen that junction block 130 is generally similar to basic block 10, except that member 132 of junction block 130 which extends between inner and outer faces 134A, 134B and 136A, 136B of junction block 130 has a right angled corner 138, whereas the corresponding longitudinal member 12 of basic block 10 has no similar interruption. Junction block 130 also differs from basic block 10 in that block 130 has first and second webs 139A, 139B respectively, whereas basic block 10 has only a single web 18. First and second webs 139A, 139B project, respectively, away from inner faces 134A, 134B of junction block 130 and at right angles to one another. Tongue and groove projections are provided on each of webs 139A, 139B for mating with those provided on the full and half height basic blocks, thereby facilitating construction of "T" interconnected walls, as will now be described with reference to FIG. 26.

Construction of "T" Interconnected Walls

FIGS. 26 and 27 illustrate the use of full and half height junction blocks 130A and 140A in conjunction with the full and half height basic blocks. More particularly, FIGS. 26 and 27 show the placement of half height junction block 140A in longitudinally and transversely interlocked relation with full height basic blocks 10A and 10B. FIGS. 26 and 27 also show how half height basic blocks 30A and 30B may then be placed in longitudinally and transversely interlocked relation with full height blocks 10A and 10B respectively.

FIGS. 26 and 27 further show the placement of a third full height basic block 10C in longitudinally and vertically interlocked relation with junction block 140A. As may be seen, a half height basic block 30C may then be placed in longitudinally and transversely interlocked relation with block 10C. Blocks 10A, 10B, 30A and 30B may be longitudinally extended to the upper right or lower left (as viewed in FIGS. 26 and 27), and vertically extended, by adding more full and half height blocks in the manner described above, to construct a first wall portion. Blocks 10C and 30C may also be longitudinally extended to the lower right (as viewed in FIG. 26—to the upper left as viewed in FIG. 27), and vertically extended as above to construct a second wall portion. The first and second wall portions form a "T" with the first wall portion constituting the "crosspiece" of the "T". The wall portions are securely interconnected longitudinally, transversely and vertically interlocking additional junction blocks, such as block 130A, on top of block 140A.

Web Block and Construction of Reduced Thickness Walls

FIGS. 28 and 29 illustrate full and half height "web" blocks 150 and 160 respectively, which may be interlocked with the full and half height basic blocks described above to provide a wall of reduced thickness which may be desired, for example, in some climates where thermal insulation of building walls is not required, or where the thicker walls produced by interlocking basic blocks are for any other reason not required or are undesirable. As may be seen by comparing FIGS. 1 and 28, web block 150 is generally similar to basic block 10, except that the portion of web block 150 corresponding to longitudinal member 12 of block 10 is truncated so that it extends only the width of web 152 of web block 150. The transverse displacement between inner and outer faces 154, 156 of web block 150 is arranged so that, when web block 150 is longitudinally and transversely interlocked with an opposed course of basic blocks, in the manner of web block 150A shown in FIG. 30, outer face 156A of web block 150A lies in the same plane as the innermost planar faces of the webs 18A, 18B of basic blocks 10A, 10B. As may be seen in FIG. 30, this results in a wall only about three-quarters thick as the wall of FIG. 4 which is constructed with parallel opposed, interlocked courses of full and half height basic blocks.

There are further similarities between the structural blocks, in addition to the provision of mating projections and recesses on each block. For example, the transverse displacement between the inner and outer faces of the corner, jamb and beam blocks is variable as described above with reference to basic block 10 of FIG. 2, thereby facilitating the construction of systems of blocks of different thicknesses, which in turn facilitates the construction of buildings having walls of varying thicknesses. The second webs of the corner and junction blocks, the butt portion of the jamb blocks and the truncated webs of the beam blocks may also be vertically apertured as illustrated in the drawings to reduce the weight of the blocks and to facilitate the insertion of reinforcing material which may be desired in some construction situations. The corner, beam and junction blocks may also have vertical apertures, as illustrated in the drawings, corresponding to and functionally equivalent to vertical apertures 26 of block 10 hereinbefore described.

As will be apparent to those skilled in the art, in light of the foregoing disclosure, many alterations and modification are possible in the practice of this invention without departing from the spirit or scope thereof. Accordingly, the scope of the invention is to be construed in accordance with the substance defined by the following claims.

I claim:

1. A structural block, comprising:

(a) a longitudinally extending member having vertical inner and outer faces;

(b) a web centred on and projecting away from said inner face and extending from top to bottom of said member along one half of the longitudinal extent of said inner face;

(c) tongue and groove projections and recesses on said inner face and on said web for mating with corresponding projections and recesses on identical blocks, whereby a plurality of said blocks may be longitudinally, transversely and vertically interlocked together.

2. A structural block as defined in claim 1, wherein the displacement between said inner and outer faces is variable.

3. A structural block as defined in claim 2, wherein said web is vertically apertured.

4. A structural block as defined in claim 3, wherein said longitudinally extending member is vertically apertured such that vertical apertures of one block will be in air communication with corresponding vertical apertures of another block interlocked above or below said one block.

5. A structural system comprised of a plurality of blocks, each of said blocks as defined in claim 1, some of said blocks being half the height of the remainder of said blocks; whereby said blocks may be longitudinally, transversely and vertically interlocked together to form a wall by:

(i) alternately placing a course of said half height blocks in longitudinally and transversely interlocked relation with a parallel, opposed course of said full height blocks, with inner faces of said courses of alternate blocks facing one another, thereby forming a base for said wall, said base having a staggered upper surface comprised, along one side of said upper surface, of the tops of said half height blocks and, along a parallel, opposed side of said upper surface, of the tops of said full height blocks;

(ii) alternately stacking full height blocks along said upper surface above said half height blocks, then along said upper surface above said full height blocks, to a desired height of said wall; and, (iii) placing half height blocks in longitudinally overlapped relation with the uppermost course of full height blocks to provide a level upper surface of said wall.

6. A corner block for use with the system of claim 5, said corner block comprising a structural block as defined in claim 1 truncated at one longitudinal end thereof by an amount equal to the displacement between said basic block inner and outer faces; and further comprising a second web at said truncated end, projecting away from the inner face of said corner block and extending from top to bottom thereof; said second web having tongue and groove projections and recesses for mating with corresponding projections and recesses on structural blocks as defined in claim 1, whereby said corner block may be interlocked with a structural block as defined in claim 1, with the outer faces of said blocks at 90° to one another.

7. A corner block as defined in claim 6, wherein the displacement between inner and outer faces of said corner block is variable.

8. A corner block as defined in claim 7, wherein said second web is vertically apertured.

9. A corner block as defined in claim 8, wherein the longitudinal portion of said corner block extending between said inner and outer faces is vertically apertured such that vertical apertures of one corner block will be in air communication with corresponding apertures of another block interlocked above or below said one corner block.

10. A jamb block for use with the system of claim 5, said jamb block comprising a structural block as defined in claim 1 having one longitudinal half thereof replaced by a rectangular butt for extending the displacement between the inner and outer faces of said butt to equal the displacement between the outer faces of a pair of opposed, longitudinally and transversely interlocked structural blocks of the type defined in claim 1.

11. A jamb block as defined in claim 10, wherein the displacement between inner and outer faces of said jamb block is variable.

12. A jamb block as defined in claim 11, wherein said butt is vertically apertured.

13. A beam block for use with the system of claim 5, said beam block comprising a structural block as defined in claim 1 in which said web is truncated to extend from the bottom of said member only about one quarter to about one half the distance to the top of said member.

14. A beam block as defined in claim 13, wherein the displacement between inner and outer faces of said beam block is variable.

15. A beam block as defined in claim 14, wherein said web is vertically apertured.

16. A beam block as defined in claim 15, wherein the longitudinal portion of said beam block extending between said inner and outer faces is vertically apertured such that vertical apertures of one beam block will be in air communication with corresponding apertures of another block interlocked above or below said one block.

17. A pilaster block for use with the system of claim 5, said pilaster block comprising a structural block as defined in claim 1 in which the displacement between said inner and outer faces is greater than the corresponding displacement of said claim 1 structural block.

18. A pilaster block as defined in claim 17, wherein the displacement between inner and outer faces of said pilaster block is variable and is greater than the corresponding displacement of structural blocks as defined in claim 1.

19. A pilaster block as defined in claim 18, wherein said pilaster block is vertically apertured between inner and outer faces of said pilaster block.

20. A junction block for use with the system of claim 5, said junction block comprising a structural block as defined in claim 1, having a right angled corner between said inner and outer faces and having first and second tongue and groove bearing web portions projecting, respectively, away from first and second right angled inner faces of said junction block.

21. A junction block as defined in claim 20, wherein the displacement between said inner and outer faces is variable.

22. A junction block as defined in claim 21, wherein said first and second web portions are vertically apertured.

23. A junction block as defined in claim 22, wherein the right angled portion of said junction block extending between said inner and outer faces is vertically apertured such that vertical apertures of one junction block will be in air communication with corresponding apertures of another block interlocked above or below said one block.

24. A web block for use with the system of claim 5, said web block comprising a structural block as defined in claim 1, wherein said longitudinally extending member is truncated to extend only the width of said web such that when said web block is longitudinally and transversely interlocked with structural blocks as defined in claim 1, the outer face of said web block lies in the same plane as the innermost faces of webs of said structural blocks as defined in claim 1.

25. A web block as defined in claim 24, wherein the displacement between inner and outer faces of said web block is variable in proportion to variation of displacement between the inner and outer faces of said structural blocks as defined in claim 1.

26. A web block as defined in claim 25, wherein said web block is vertically apertured.

* * * * *